US008096426B2

(12) United States Patent
Vivas

(10) Patent No.: US 8,096,426 B2
(45) Date of Patent: Jan. 17, 2012

(54) INCLINED UNIVERSAL TRAY FOR PAPER AND THE LIKE

(76) Inventor: Carlos Vivas, Caracas (VE)

( * ) Notice: Subject to any disclaimer, the term of this patent is extended or adjusted under 35 U.S.C. 154(b) by 0 days.

(21) Appl. No.: 12/500,695

(22) Filed: Jul. 10, 2009

(65) Prior Publication Data

US 2011/0006019 A1 Jan. 13, 2011

(51) Int. Cl.
*A47F 7/14* (2006.01)
*B65D 1/34* (2006.01)
*B65D 21/02* (2006.01)

(52) U.S. Cl. ..... 211/55; 211/10; 206/558; 220/23.4

(58) Field of Classification Search ..... 211/10, 211/11, 45, 50, 51, 52, 55, 126.13, 128.1, 211/184, 46; 312/108, 111, 183; 40/124, 40/124.2, 124.4; 108/60; 206/509, 504, 206/557, 558, 561; D19/90; 220/23.2, 23.4, 220/23.8, 553, 555
See application file for complete search history.

(56) References Cited

U.S. PATENT DOCUMENTS 188,519 A * 3/1877 Lamoree ..... 211/55
668,727 A * 2/1901 Chapman ..... 220/23.83
786,176 A * 3/1905 Adams ..... 211/128.1
792,427 A * 6/1905 Knudsen ..... 312/200
920,670 A * 5/1909 Scott ..... 220/23.4
1,156,401 A * 10/1915 Hawley ..... 40/124.2
1,544,920 A * 7/1925 Manley et al. ..... 312/183
1,713,147 A * 5/1929 Ruze ..... 211/50
2,112,498 A * 3/1938 Lax ..... 312/352
2,303,971 A * 12/1942 Willy et al. ..... 211/50
2,532,600 A * 12/1950 Broersma ..... 211/55
2,742,161 A * 4/1956 Nuttall ..... 211/11
2,751,088 A 6/1956 Hargett
2,940,455 A * 6/1960 Guichard ..... 211/50
3,178,029 A * 4/1965 Myers ..... 211/10
3,190,242 A * 6/1965 Shelly ..... 108/60
3,887,076 A * 6/1975 Larsen ..... 211/10
4,023,681 A * 5/1977 Plant ..... 211/74
4,062,452 A * 12/1977 Bartholomew ..... 211/55
4,081,080 A * 3/1978 Rorex ..... 211/55
4,083,456 A * 4/1978 Genn et al. ..... 211/55
4,102,072 A * 7/1978 Buschman ..... 40/124.2
D250,960 S * 1/1979 Bitner et al. ..... D19/90
D276,777 S * 12/1984 Evenson ..... D6/473
4,577,914 A * 3/1986 Stravitz ..... 312/9.9
4,613,047 A * 9/1986 Bushyhead et al. ..... 211/55
4,871,218 A * 10/1989 Swinson ..... 312/312
D306,041 S * 2/1990 Evenson ..... D19/90
4,944,412 A 7/1990 Daigre
4,974,733 A 12/1990 Evans (Continued)

*Primary Examiner* — Darnell Jayne
*Assistant Examiner* — Joshua Rodden
(74) *Attorney, Agent, or Firm* — Gifford, Krass, Sprinkle, Anderson & Citkowski, P.C.

(57) ABSTRACT

A tray assembly for supporting papers, folder, files, or smaller articles such as vouchers and ticket books includes a plurality of identical tray modules configured to be joined end to end or stacked upon one another. Each tray module includes a plurality of rectangular slots which are slanted with regards to a vertical plane which allows for easy recognition of a top sheet and simplified insertion and removal of sheets and other items to be supported within the slots of the trays. The rectangular slots of each tray module include a plurality of grooves which can receive separators for dividing the rectangular slots into multiple compartments. Additionally, each rectangular slot includes a stop flange, and wherein the stop flanges of the rectangular slots can be used to attach individual tray modules to a vertical surface such as a wall.

7 Claims, 4 Drawing Sheets

U.S. PATENT DOCUMENTS 5,085,328 A * 2/1992 Evenson ..... 211/55
D333,489 S * 2/1993 Stern et al. ..... D19/90
5,222,609 A * 6/1993 Eaton ..... 211/55
D349,131 S * 7/1994 Nystrom et al. ..... D19/90
5,411,135 A * 5/1995 Danzyger et al. ..... 206/758
D361,349 S * 8/1995 Brussing ..... D19/90
D363,950 S * 11/1995 Brussing ..... D19/90
5,497,888 A * 3/1996 Michaels et al. ..... 211/10
5,575,396 A * 11/1996 Smed ..... 211/11
5,641,074 A * 6/1997 Smed ..... 211/11
5,971,826 A * 10/1999 Delzompo et al. ..... 446/75
6,006,927 A * 12/1999 Levy ..... 211/51
6,213,313 B1 * 4/2001 Levy ..... 211/51
7,097,049 B1 * 8/2006 Singer et al. ..... 211/55

* cited by examiner

INCLINED UNIVERSAL TRAY FOR PAPER AND THE LIKE

FIELD OF THE INVENTION

This invention relates to multiple compartment trays for papers, files, and the like as well as smaller articles and more particularly to modules formed of a plurality of such trays arranged so that the trays are inclined to the vertical when supported on a horizontal surface.

BACKGROUND OF THE INVENTION

Most multi-compartment trays for supporting papers, folders, files, or other generally flat items such as tickets, compact discs, and the like are arranged with horizontal shelves or compartments for supporting the items so that locating a particular item supported in the tray usually involves lifting the uppermost items successively until a desired item is found.

Another problem associated with present paper trays of the type for use in an office is that while they are usually sized to accommodate sheets of office size paper, they cannot appropriately store smaller items such as cards, bank slips, CDs, or the like in an organized manner.

SUMMARY OF THE INVENTION

The present invention is accordingly directed toward an improved tray adapted for use on an office desktop or to be hung on a wall adjacent to an office desk or the like, which provides a plurality of tray sections which are inclined at an angle relative to the vertical so that flat paper sheets disposed in the tray sections will be self-supporting in a manner which allows easy recognition of the top sheet and simplified insertion and removal of sheets and other items to be supported within the various compartments of the tray.

A preferred embodiment of the invention, which will subsequently be disclosed in detail, comprises one or more multi-tray modules which are adapted to be used separately or joined together in either substantially a horizontal or a vertical alignment so as to form larger groups of trays. The trays may be formed of a rigid sheet material such as plastic or metal, although a preferred embodiment is formed of a transparent plastic such as Lucite or the like to aid in the viewing of items supported in the tray sections. Each module preferably comprises a plurality of tray cells, such as three to seven or the like. Each cell comprises a flat planar wall and bottom and top sections extending normally to the wall and integrally fixed with the wall section of a similar cell to form an integrated module.

At least the bottom sections of each of the cells forming a module are staggered along the plane of the wall sections of any forward or rear cell by a small distance so that when a module comprising a plurality of cells is supported on a flat horizontal surface such as a desktop, the intersection between each cell's wall surface and its bottom surface will rest on the supporting surface and the tray structure will be inclined at an angle relative to the vertical that depends upon the degree to which adjoining cells are staggered relative to one another. In a preferred embodiment of the invention, his inclined angle may preferably be roughly 70 degrees with respect to the horizontal surface and 20 degrees relative to the vertical. This angle is approximate at best and not critical, and in other embodiments of the invention the planar surfaces of the cells making up a module could be inclined at differing angles.

The height of each cell is sufficient to accommodate a conventional sized office paper or file, such as 10-14 inches. Thus, in a module consisting of five planar wall sections, five vertically inclined cells each defined by the two adjacent walls are provided for insertion of papers or files from the sides of the cells.

The preferred embodiment of the paper tray is formed with grooves on both sides of the planar walls. The grooves are horizontal and extend the full width of the walls. The tray set includes a plurality of elongated flat rectangular separators, preferably made of the same material as the trays themselves, which are adapted to be supported in a facing pair of grooves at the rear of one planar wall and the forward side of an adjacent planar wall. In a preferred embodiment of the invention, two pairs of grooves are provided for each cell, but other numbers of grooves could be employed in other embodiments of the invention. The separators create a number of compartments along the height of the cell to accommodate relatively small items. Separators may be inserted in certain of the trays and not in others so that some can support fill height files or papers and others can support smaller office items.

The far horizontal ends of each of the cells are formed with a forward facing wall at one extreme end to prevent papers or other articles inserted from the opposite end from falling out of the far end.

In a preferred embodiment of the invention, the rear side of the last wall of the module is equipped with a slotted upward facing groove at the top end and a slotted downward facing groove at the lower end. These grooves can accept upward and downward extending flanges formed at the forwardmost wall of another multi-cell module to join two or more modules together in a horizontal arrangement. Sets of trays may be joined together vertically because the staggered bottom of one set of modules will fit within the staggered top of an underlying set of modules. Thus the modules may be stacked in any combination vertically or horizontally.

The side stops formed at one horizontal end of each of the modules may be formed with holes adapted to engage screws or nail heads affixed in a vertical wall. Two vertically staggered holes are provided and when joined on horizontally arrayed screw or nail heads affixed to the wall, will support the modules at the desired slant angle, such as 70 degrees.

BRIEF DESCRIPTION OF THE DRAWINGS

Other objects, advantages and applications of the present invention will be made apparent by the following detailed description of a preferred embodiment of the invention. The description makes reference to the accompanying drawings in which.

DETAILED DESCRIPTION OF THE PREFERRED EMBODIMENT

Figure 1:
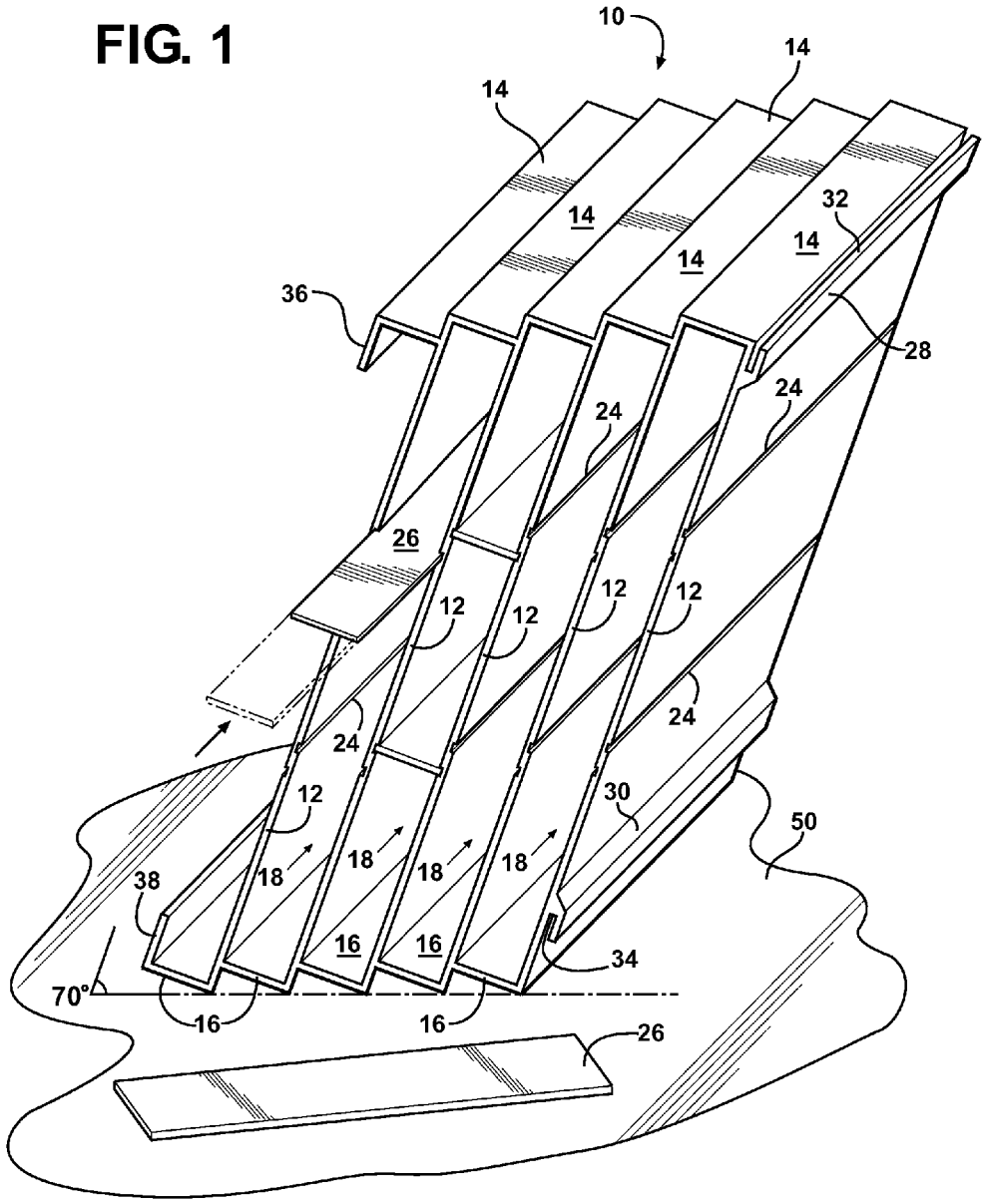
FIG. 1 is a perspective view, from the rear and a first side of a multi-cell inclined paper tray module constituting a preferred embodiment of the present invention and separators for insertion in the module.
Figure 4:
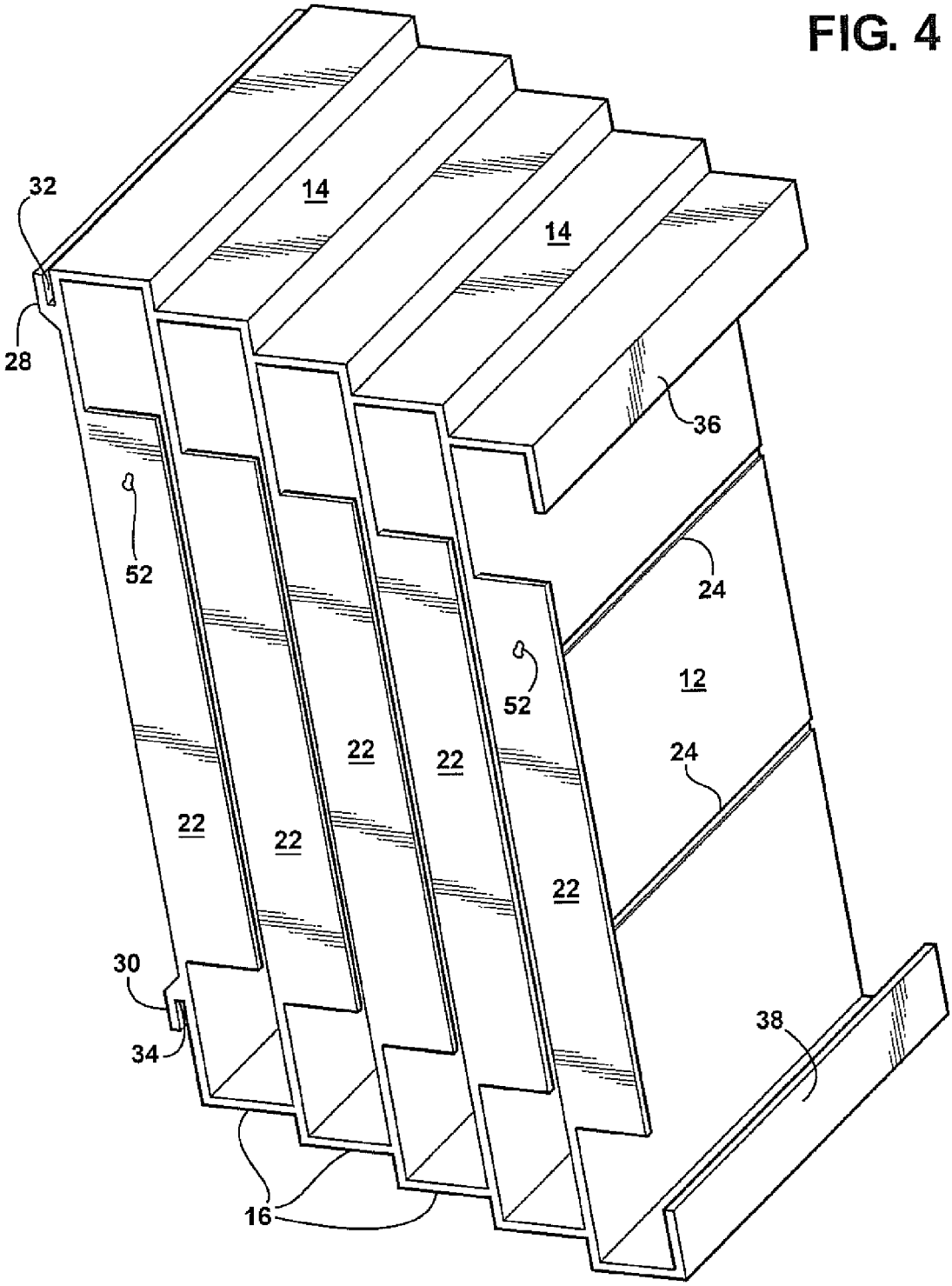
FIG. 4 is a view from the front and second side of the module of FIG. 1.

Referring to the drawings, a preferred embodiment of the inclined universal paper tray is generally indicated at 10. The tray module 10 is formed of a rigid sheet material, preferably a plastic, although alternatively a metal. The plastic is preferably, though not necessarily, transparent or translucent such as a polycarbonate, an acrylic, or a polystyrene. Lucite is a preferable material. The preferred embodiment of the module comprises a series of planar walls 12. The walls preferably have a height and width which will allow the modules to accommodate standard office paper and files, such as 14 inches high by 8 inches wide. The walls 12 are joined to one another in a parallel spaced relationship by integrally formed slot tops 14 and slot bottoms 16. The tops and bottoms 14 and 16 extend at right angles to the planes of the slot walls 12 and are relatively short, such as 1-4 inches. Thus, the space between a pair of adjacent walls forms a slot 18 for the reception of papers, files, or the like. The five walls 12 of a preferred embodiment of the invention produce four slots 18 between the walls. The slots 18 are closed at one end by the tops 14 and at the other end by the bottoms 16. The side ends of the slots 18, as viewed in FIG. 1, are open. At the other side, illustrated in FIG. 4, the slot end is blocked by end flanges 22, formed integrally with the vertical edges of the side walls and projecting normally thereto. The flanges 22 have a width slightly less than the width of a slot 18 and serve to prevent papers, files, and like objects inserted from the open vertical edge of each slot from extending beyond the flanges 22.

The side walls 12 of the slots are formed with grooves 24 on both of their sides extending across the fill width of each side wall. The grooves are arranged such that the grooves 24 on one side wall are in opposition to the similar grooves on an opposed side wall.

A plurality of rectangular separators 26 having a length equal to the full width of the walls 12 and a width equal to the space between a pair of opposed grooves 24 are provided. They may be inserted into a slot with their edges riding in the opposed grooves 24 on a pair of facing walls. These grooves are arranged so that a separator 26 will then extend normally to the walls which support it and parallel to the slot tops 14 and the slot bottoms 16. In the preferred embodiment, two pairs of the grooves 24 are spaced along each side of one of the walls 12 so two separators may be accommodated. In other embodiments a differing number of grooves might be provided in each wall. In the embodiment of FIG. 1, the separators 26 may be inserted to divide a slot 18 into three compartments for the receipt of small items such as pencils, checkbooks, and the like. The separators 26 may be used to divide certain of the slots, and other of the slots are left unobstructed.

Figure 2:
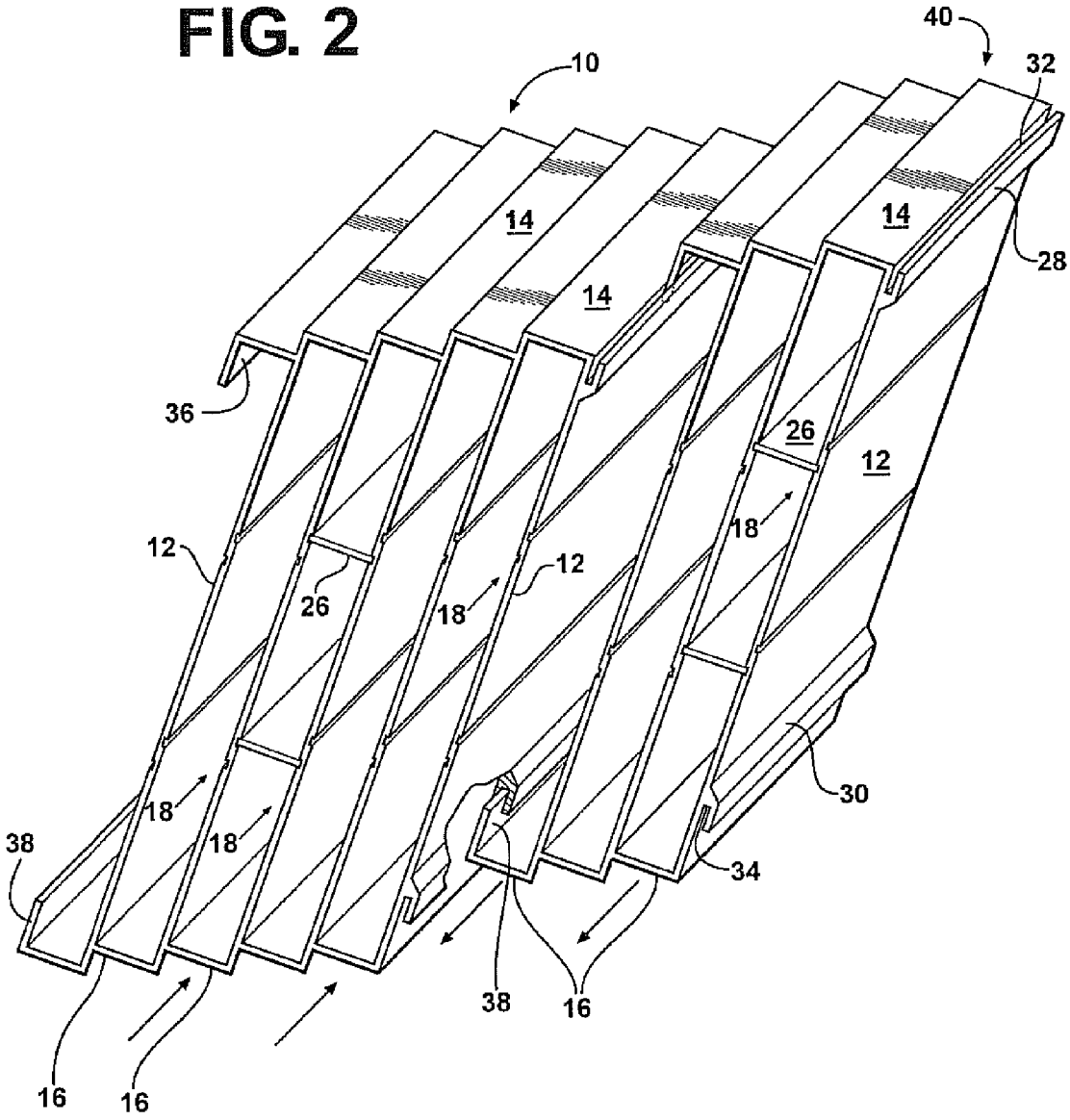
FIG. 2 is a partially broken away perspective view of the module of FIG. 1 being joined to a similar module, in horizontal relationship.

Each paper tray module 10 has a pair of structures 28 and 30 extending across the width of the rearmost wall of the module adjacent the top edge and near the bottom edge respectively. The member 28 has a dovetail slot 32 facing upwardly formed along its inner edge, and the structure 30 has a similar slot 34 facing downwardly. These slots may be interlocked with a downwardly extending flange 36 formed at the end of the top of the foremost wall 12 and an upwardly extending flange 38 formed at the end of the bottom 16 formed in the front wall 12 in a manner illustrated in FIG. 2 to interlock a pair of modules in horizontal relationship to form a greater number of slots than contained in a single module. In FIG. 2 the module 10 of the type illustrated in FIG. 1, is interlocked with a module generally indicated at 40, which has three side walls 12 forming two modules. A forward wall of the module 40 acts in cooperation with the rear wall 12 of the module 10 to form an additional slot, giving the unit a total of seven slots.

In a similar manner, the modules may be joined vertically, with the slot bottoms 16 of one module supported on the slot tops 14 of another module.

The fact that the slot bottoms 16 are staggered with respect to one another along the height of the walls 12 produces a bottom construction which, when supported on a horizontal base 50 (FIG. 1) which might be a desktop or tabletop, inclines the paper tray module with respect to the vertical. As illustrated in FIG. 1, this inclination may be 70 degrees to the horizontal and 20 degrees to the vertical, but is not critical, and the angle relative to the vertical might range from about 6 degrees to 30 degrees. This inclination allows lightweight paper sheets to be supported within the slots without collapsing vertically. It also allows easy inspection of the contents of the slots from the forward end.

Figure 3:
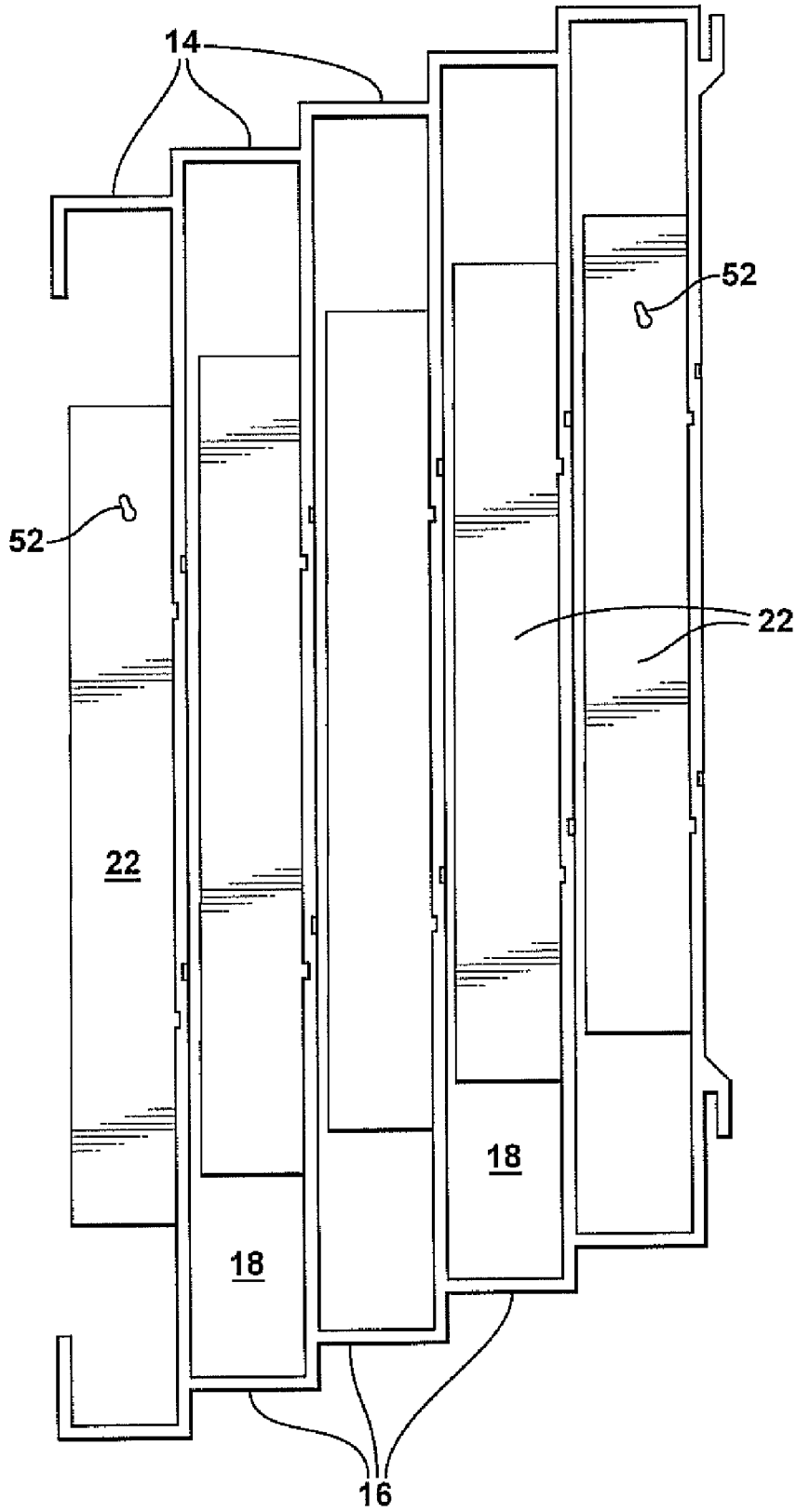
FIG. 3 is a view of the module of FIG. 1 from the first side.

As illustrated in FIG. 3, a pair of the side flanges 22, preferably one at the forward end and one at the rear end of the module, are formed with holes 52 formed near their tops, which allows them to engage screws or nail heads affixed to a horizontal wall. The two holes 52 are staggered vertically so that the walls of the paper tray module will be inclined with respect to the horizontal at approximately the 70 degree angle or reasonable variations therefrom when the holes 52 are used to hang the module on a pair of horizontally arrayed screw or nail heads.

Having thus described my invention, I claim:

1. A freestanding modular inclined paper tray assembly comprising a plurality of multi-compartment paper tray modules, each multi-compartment paper tray module comprising:

a plurality of rectangular slots formed by a plurality of spaced parallel side walls, each side wall having a top and bottom end, with adjoining slots sharing common walls, such that each slot has a first and second parallel side wall, with said second parallel side wall being the first parallel side wall of a respective adjacent slot;

a slot top and a slot bottom extending normally between the first and second spaced parallel side walls of each slot to join the parallel side walls of each slot together in an integral parallel spaced relationship;

each slot bottom extending normally from the bottom of its respective second spaced parallel side wall to a line on the opposing, respective, first spaced parallel side wall, spaced from the bottom of the opposing, respective, first spaced parallel side wall, so that when the bottom of a paper tray assembly is supported on a horizontal planar surface, the parallel side walls of the slots are inclined at an angle to the vertical;

the outer side of one of the first spaced parallel side walls forming a first end of the multi-compartment paper tray module including a top flange extending parallel to and adjacent to the top edge of such spaced parallel wall, such flange extending downwardly parallel to such spaced parallel side wall, and a corresponding bottom flange extending parallel to and adjacent the bottom edge of such spaced parallel side wall and extending upwardly parallel to such spaced parallel side wall, the outer side of one of the second parallel side walls forming a second end of the multi-compartment paper tray module and including dovetail slots extending across the top and the bottom of such spaced parallel side wall, respectively, wherein the flanges of the multi-compartment paper tray module are adapted to engage said dovetail slots of another multi-compartment paper tray module so as to join a pair of multi-compartment paper tray modules together along an inclined plane.

2. The modular inclined paper tray assembly of claim 1 including grooves formed on both sides of the spaced parallel walls of each of the plurality of tray modules, said grooves extending parallel to the slot tops and bottoms for the full width of the walls and planar rectangular separators having a width equal to the space between the slots on the respective first and second spaced parallel side walls of each slot so that the separators may be supported within the slots and extend substantially the full width of the slots.

3. The modular inclined paper tray assembly of claim 1 wherein each said multi-compartment paper tray module is formed of a plastic.

4. The modular inclined paper tray assembly of claim 3 in which the plastic is transparent.

5. The modular inclined paper tray assembly of claim 4 in which the transparent plastic comprises one of the group of Lucite, polycarbonate, acrylic, or polystyrene.

6. The modular inclined paper tray assembly of claim 1 including stop flanges formed on a first side of each second spaced parallel side wall, respectively, and projecting normally to the second spaced parallel side wall so that objects inserted into a respective slot of each second spaced parallel side wall are blocked by the stop flanges.

7. The modular inclined paper tray assembly of claim 1 wherein said flange adjacent to the top edge of the first spaced parallel wall forming the first end of the multi-compartment paper tray module extends downwardly parallel to said flange adjacent to the bottom edge of the first spaced parallel wall forming the first end of the multi-compartment paper tray module.

* * * * *